US006364733B1

(12) United States Patent
Escauriza et al.

(10) Patent No.: US 6,364,733 B1
(45) Date of Patent: Apr. 2, 2002

(54) DISPLAY BALLOON KIT AND METHOD OF ASSEMBLY

(76) Inventors: Enrique L. Escauriza; Ali Gonzalez, both of 4430 NW. 207th Dr., Miami, FL (US) 33055

( * ) Notice: Subject to any disclaimer, the term of this patent is extended or adjusted under 35 U.S.C. 154(b) by 0 days.

(21) Appl. No.: 09/393,793

(22) Filed: Sep. 10, 1999

Related U.S. Application Data

(63) Continuation-in-part of application No. 09/017,249, filed on Feb. 2, 1998, now abandoned.

(51) Int. Cl.[7] ..... A63H 27/10
(52) U.S. Cl. ..... 446/225; 446/88
(58) Field of Search ..... 446/223, 226, 446/225, 88, 89, 220; 40/617, 124.14; 229/103, 103.3, 117.06, 164.1

(56) References Cited

U.S. PATENT DOCUMENTS

| | | | | | |
|---|---|---|---|---|---|
| 344,515 | A | * | 6/1886 | Biehl | 446/225 |
| 2,563,619 | A | * | 8/1951 | Ringler | 229/37 |
| 2,701,935 | A | * | 2/1955 | Florence | 446/225 X |
| 2,998,178 | A | * | 8/1961 | Jacke | 229/14 |
| 3,286,900 | A | * | 11/1966 | Keith | 229/16 |
| 4,038,777 | A | * | 8/1977 | Schwartz | 446/223 |
| 4,145,838 | A | * | 3/1979 | Mason | 446/223 |
| 4,177,991 | A | * | 12/1979 | Meyer et al. | 273/95 |
| 4,319,418 | A | * | 3/1982 | Transport | 40/124.1 |
| 4,758,199 | A | * | 7/1988 | Tillotson et al. | 446/225 |
| 4,784,628 | A | * | 11/1988 | McArdle et al. | 446/225 |
| 4,810,223 | A | * | 3/1989 | Stockton | 446/225 |
| 4,884,987 | A | * | 12/1989 | Mason | 446/225 |
| 4,931,028 | A | * | 6/1990 | Jaeger et al. | 446/225 |
| 5,531,401 | A | * | 7/1996 | NewComb | 446/222 |
| 5,813,627 | A | * | 9/1998 | Huntington | 244/33 |
| 5,882,240 | A | * | 3/1999 | Larsen | 446/225 |

* cited by examiner

*Primary Examiner*—John A. Ricci
(74) *Attorney, Agent, or Firm*—Frank L. Kubler

(57) ABSTRACT

A kit for assembly of an entertainment apparatus includes a party balloon for filling with gas which is buoyant in air at ambient pressure and temperature; a basket structure form sheet including interconnected first, second, third and fourth basket wall panels and a basket floor panel, all of the panels being separated from each other by fold lines, and a panel interconnecting mechanism for holding the side wall panels and floor panel juxtaposed in the configuration of a basket; and a suspension harness including at least one elongate flexible member wrapped around the inflated party balloon and extending downwardly to and engaging the basket structure. The panel interconnecting mechanism preferably includes several slots near the edges of the floor panel and dove tail tabs protruding from the edges of the wall panels which fit engagingly into the slots to hold the assembled basket in folded, assembled configuration. The party balloon is preferably of the translucent colored elastic type, and alternatively of the opaque plastic non-elastic mylar type formed of two half-portions joined together at a circumferential seam.

14 Claims, 7 Drawing Sheets

DISPLAY BALLOON KIT AND METHOD OF ASSEMBLY

FILING HISTORY

This application is a continuation-in-part of application Ser. No. 09/017,249 filed on Feb. 2, 1998, now abandoned, which is based upon the contents of Disclosure Document Number 428120 filed on Nov. 25, 1997.

BACKGROUND OF THE INVENTION

1. Field of the Invention

The present invention relates generally to the fields of entertainment devices, ornaments and novelty items primarily used at celebrations. More specifically the present invention relates to a display balloon assembly kit including a conventional party balloon and a specialized harness and elements for assembly of a basket, the resulting balloon apparatus being suggestive of the larger passenger balloons, with means for displaying messages and a method of kit assembly.

The primary contemplated uses for the apparatus assembled from the kit are as a novelty item and ornament at parties, birthdays, open houses, baby showers, weddings, and for general decoration and entertainment.

2. Description of the Prior Art

There have long been helium-filled elastic and mylar balloons for parties and other celebrations. These balloons are typically tied to furniture with string and provide a colorful, carnival atmosphere. The mylar balloons sometimes have party messages printed on them. A problem with these balloons has been that their entertainment uses are highly limited, and their appearance monotonous and uninteresting.

It is thus an object of the present invention to provide a kit for assembling a stylized display balloon and basket apparatus which attracts attention and interest by suggesting the appearance of the very large passenger balloons.

It is another object of the present invention to provide such a kit which combines a conventional party balloon with an inventive miniature basket and harness assembly, the basket being assembled from a form sheet which is cut to define interconnected basket wall panels and a basket floor panel, all panels being separated from each other by fold lines and having slots and correspondingly located dove tail tabs at panel edges which fit engagingly together to hold the sheet in a folded, assembled three-dimensional basket configuration.

It is still another object of the present invention to provide such a kit in which the harness is configured to easily slide onto and off of a conventional party balloon when inflated.

It is a still further object of the present invention to provide such a kit in which the harness is made from common, attractive and inexpensive materials such as gift wrap ribbon, and the basket form sheet from colored cardboard.

It is finally an object of the present invention to provide such a kit which is highly compact before apparatus assembly for compact storage, and which is inexpensive to manufacture.

SUMMARY OF THE INVENTION

The present invention accomplishes the above-stated objectives, as well as others, as may be determined by a fair reading and interpretation of the entire specification.

A kit is provided for assembly of an entertainment apparatus, including a party balloon for filling with gas which is buoyant in air at ambient pressure and temperature; a basket structure form sheet including interconnected first, second, third and fourth basket wall panels and a basket floor panel, all of the panels being separated from each other by fold lines, and a panel interconnecting mechanism for holding the side wall panels and floor panel juxtaposed in the configuration of a basket; and a suspension harness including at least one elongate flexible member wrapped around the inflated party balloon and extending downwardly to and engaging the basket structure.

The party balloon is preferably of the translucent colored elastic type, and alternatively of the opaque plastic non-elastic mylar type formed of two half-portions joined together at a circumferential seam. The inflated party balloon has a diameter, and the suspension harness preferably includes a loop of ribbon of smaller diameter than the inflated party balloon diameter and resting on and around the upper portion of the inflated party balloon and several of the elongate flexible members tied to the loop of ribbon and extending downwardly to and secured to the basket structure. The lower ends of the elongate flexible members are optionally glued to the basket structure. The basket structure optionally includes slots, and the lower ends of said elongate flexible members are in that instance fitted through the slots in the basket structure. The basket structure preferably includes a cup-shaped structure having at least one side wall and a bottom wall. The basket structure is optionally made of cardboard, or of plastic. The basket structure optionally includes a message carrying sign. The sign preferably includes an upright strip secured to the at least one side wall of said basket structure and projecting upwardly to a height above the at least one side wall. The strip has an upper end and the upper end of the strip optionally extends laterally to provide a broad display surface on which a message is displayed. The party balloon has a central side region and the harness loop of ribbon is optionally elastic and resiliently grips the central side region of the party balloon.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
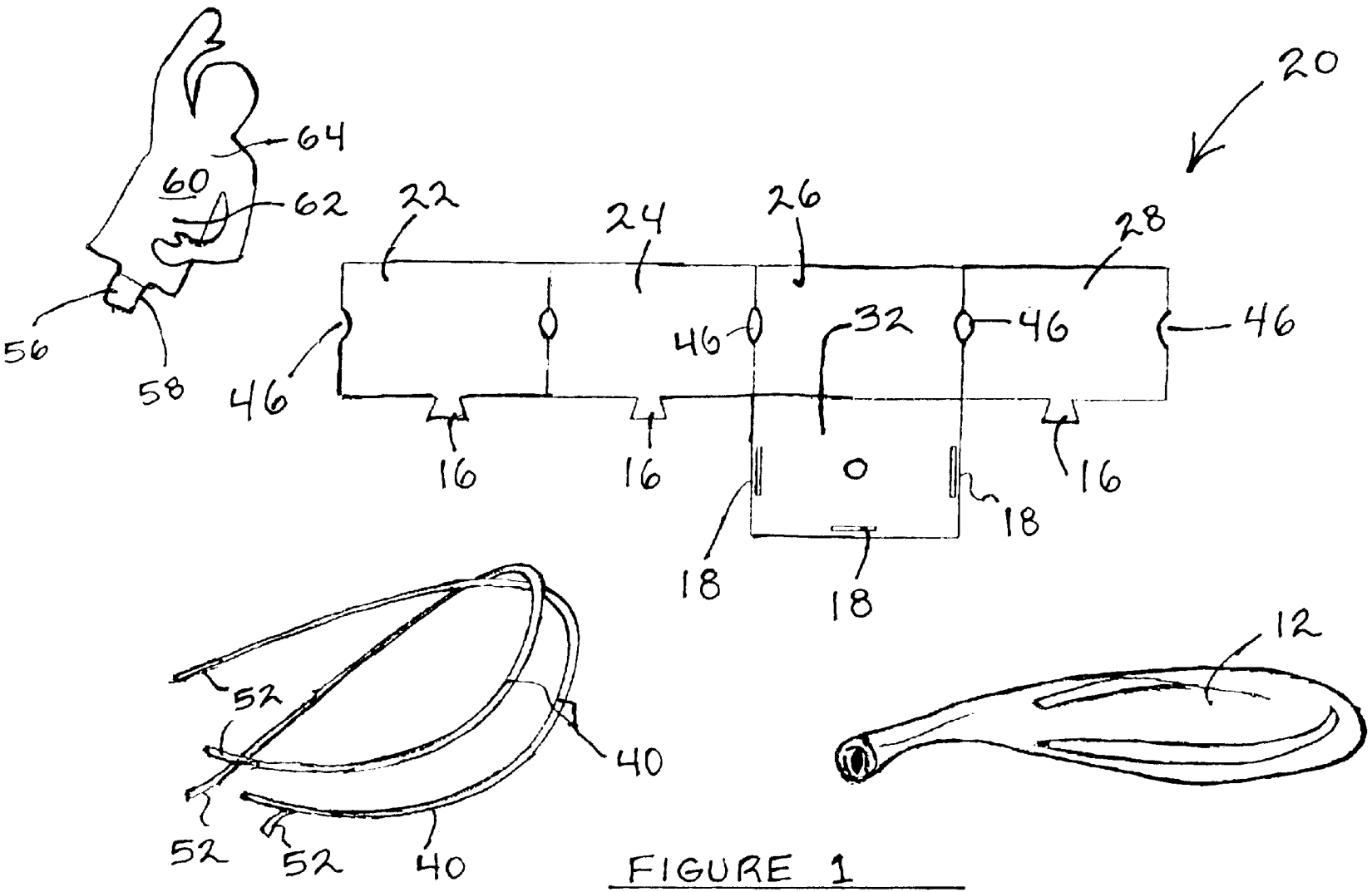
FIG. 1 is a top view of the unassembled kit, showing the primary preferred elements, including the preferred multi-sided basket form sheet, and a non-inflated, conventional party balloon.
Figure 2:
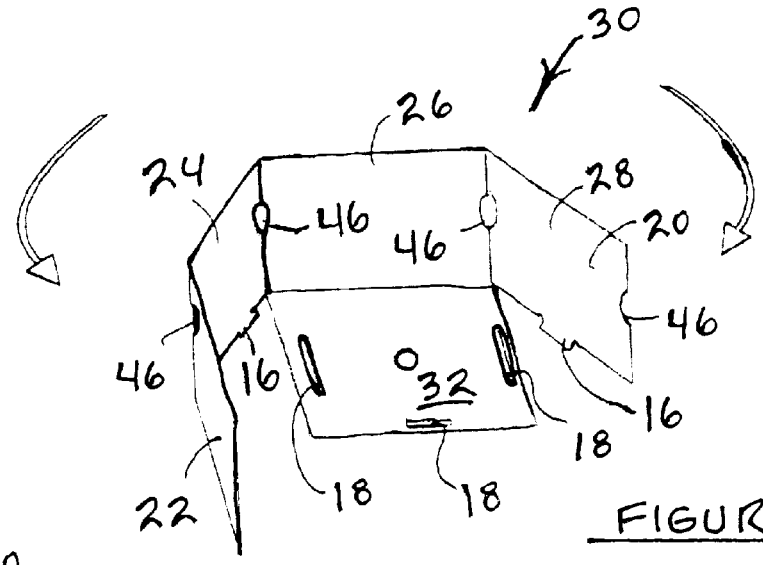
FIG. 2 is perspective side view of the basket form sheet of FIG. 1, shown folded into a partially assembled configuration.
Figure 3:
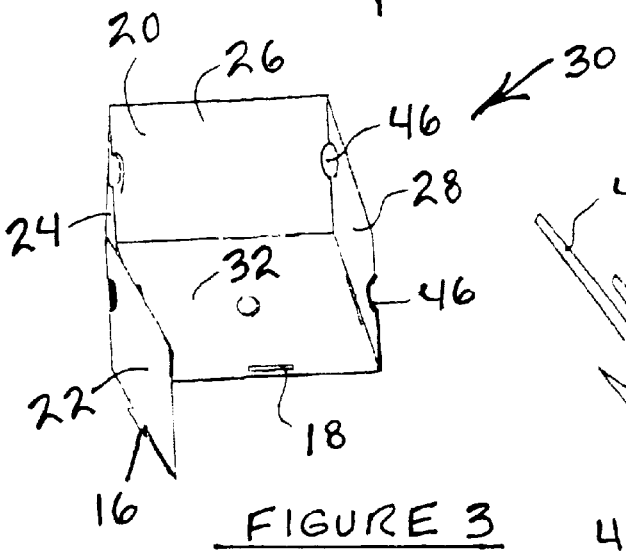
FIG. 3 is progression of the perspective view of FIG. 2, showing the basket form sheet still further assembled, with some of the tabs fitted into corresponding slots.
Figure 4:
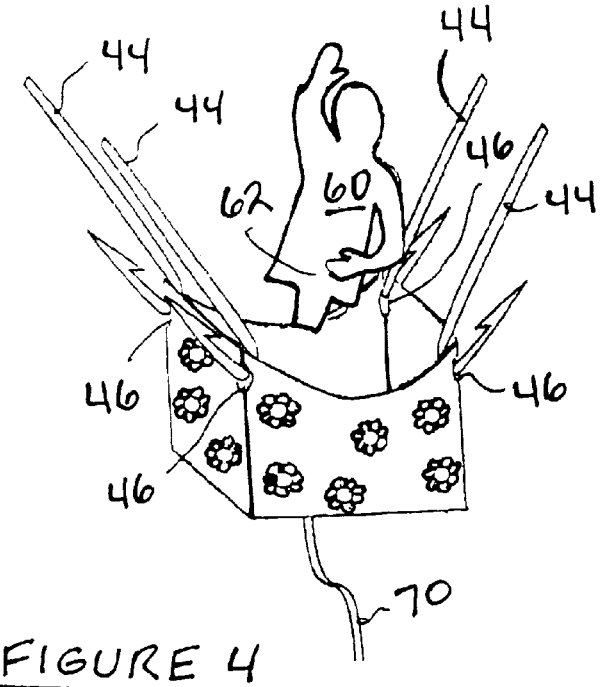
FIG. 4 is perspective view of the fully assembled basket, and the lower ends of the harness ribbons with the optional hooked or barbed ribbon ends and the sign positioned above the basket for attachment to a basket side wall.
Figure 5:
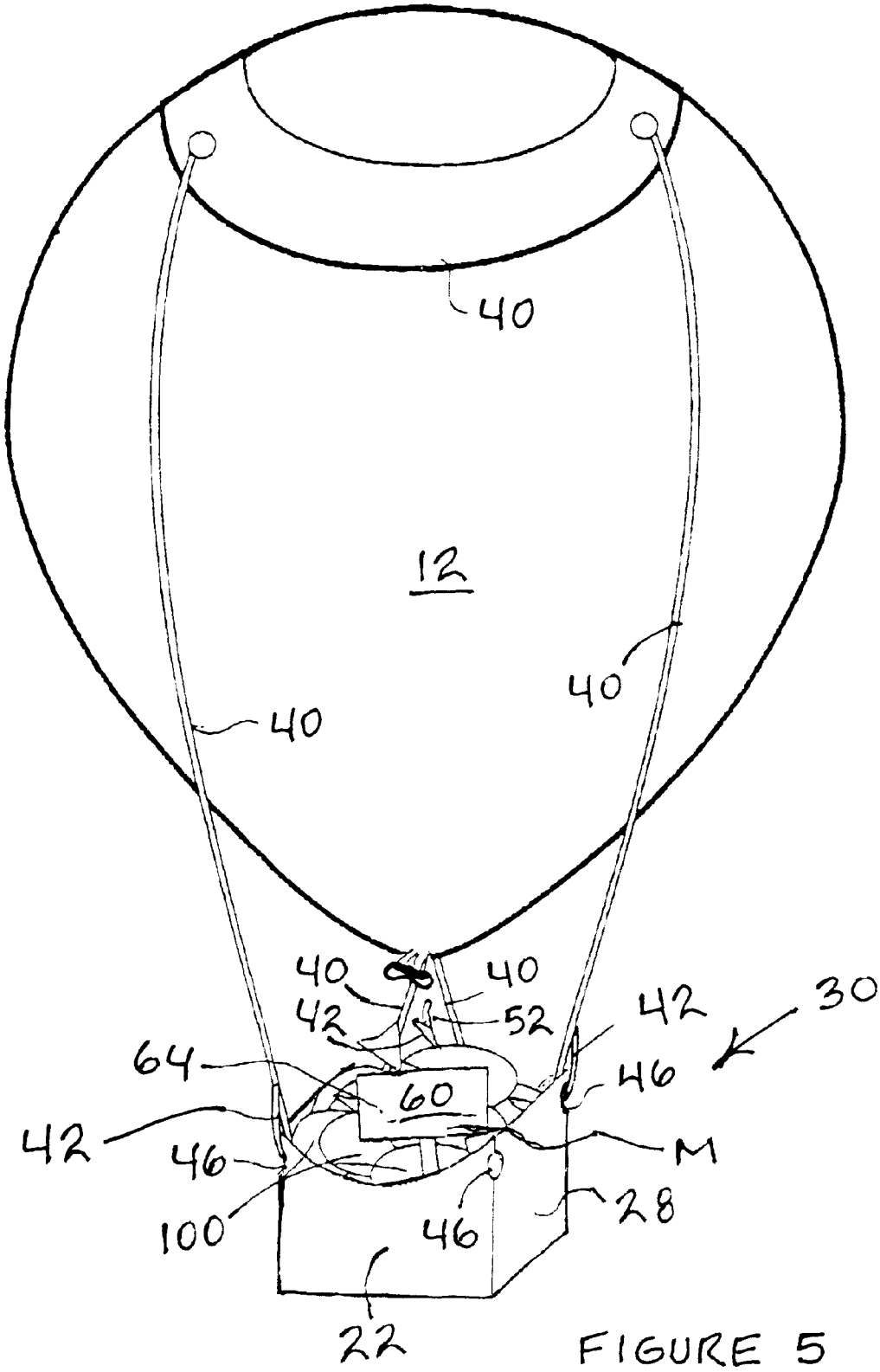
FIG. 5 is a perspective view of the balloon apparatus resulting from fully assembling the kit, the basket containing arbitrary items.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–14, a display balloon kit 10 is disclosed for constructing a balloon apparatus 50 for entertaining and advertising which includes a conventional party balloon 12, inflatable to a size of several inches in diameter and which is filled with helium. Party balloon 12 is understood to be of the common translucent, colored elastic type or of the opaque plastic or mylar non-elastic type formed of two half-portions joined together at a circumferential seam and often displaying party messages in glossy metallic color. Other equivalent types of party balloons 12 are contemplated within this general size range.

Kit 10 further includes a basket which is cut to define interconnected first, second, third and fourth basket wall panels, 22, 24, 26 and 28, respectively, and a basket floor panel 32, all separated from each other by fold lines 14 and having slots 18 near floor panel 32 edges and dove tail tabs 16 protruding from wall panel 22, 24 or 26 edges which fit engagingly into slots 18 to hold resulting basket 30 in its folded, assembled configuration. Side wall panels 22–28 are optionally cut to arch downwardly for aesthetic enhancement.

Figure 6:
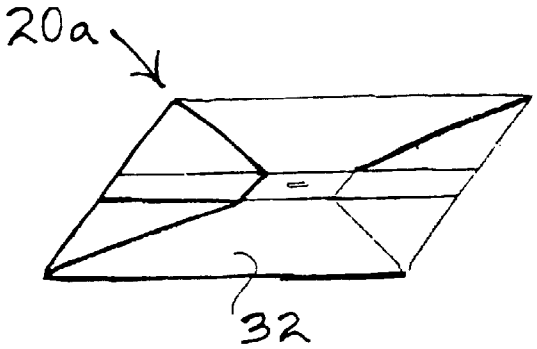
FIG. 6 is a perspective view of the alternative basket form sheet, shown complete folded flat as it is provided in the kit.
Figure 7:
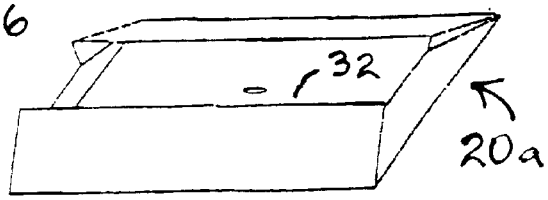
FIG. 7 shows the basket form sheet of FIG. 6 partly opened, with the side walls partly lifted off the basket bottom wall.
Figure 9:
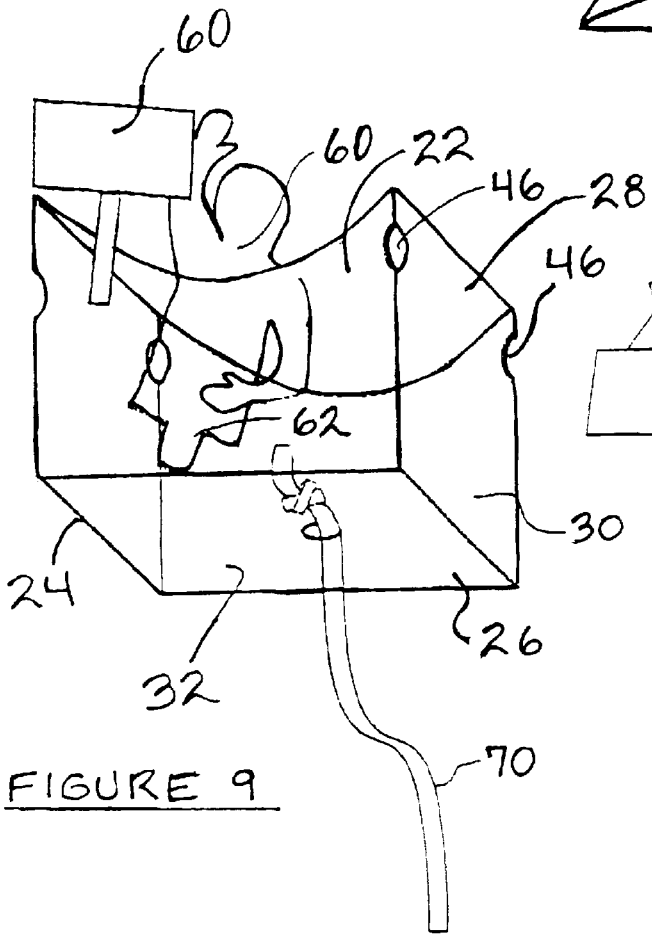
FIG. 9 is a perspective view of the basket of assembled from the form sheet of FIGS. 1 and 2, showing the trailing stabilizing ribbon tied within a central opening in the basket floor, and two alternative sign forms positioned for bonding to the basket side wall inner surface.
Figure 8:
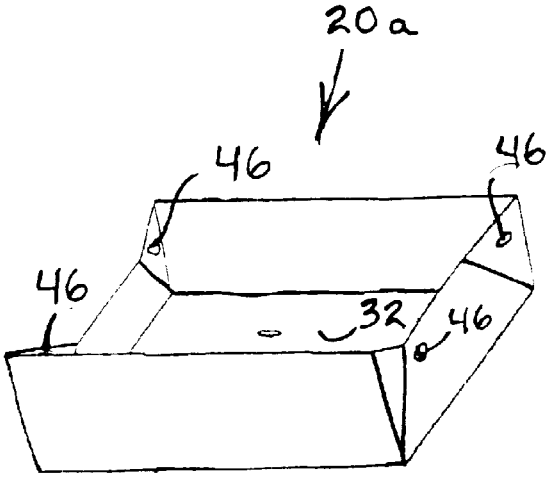
FIG. 8 shows the basket form sheet of FIGS. 6 and 7 almost entirely opened to form the desired basket for suspension below the balloon on the harness.
Figure 13:
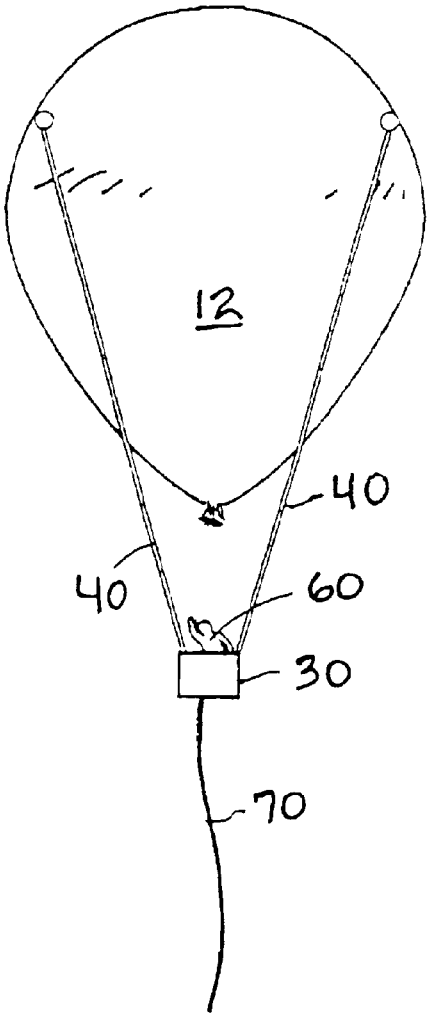
FIG. 13 is a perspective full view of the assembled balloon apparatus, in which the harness ribbons are secured to the balloon with circular adhesive ribbon upper end portions. These upper end portions are provided in the kit with an adhesive layer covered with removable cover sheets to expose the adhesive to connect the ribbon upper ends to the balloon, as shown.

Alternatively, the form sheet **20*a* is a collapsed preassembled box as in FIGS. 6–8, in which the basket side walls are folded at angles to rest flat against the basket floor. This latter form sheet 20*a* is assembled into a basket 30** by simply pulling the basket side walls upwardly and away from the basket floor.

Kit 10 further includes a suspension harness 40 of interconnected ribbons or lines wrapped around the inflated balloon 12 and extending downwardly to and engaging the basket 30. See FIG. 5. Suspension harness 40 preferably includes a circle or loop of ribbon 42 of smaller diameter than the inflated balloon 12 and resting on and around the upper portion of balloon 12, and several, preferably four, interconnection ribbons 44 tied to the loop of ribbon 42 and extending downwardly to basket 30. The lower ends of interconnection ribbons 44 are preferably either glued to or fitted through harness ports 46 in assembled basket 30 where side wall panels meet, and ribbon ends are then tied around ports 46. Alternatively, ribbon 44 lower ends or are bound with ribbon adhesive patches covered with ribbon adhesive cover sheets 52 which are peel away so that the harness ribbon 44 lower ends can be looped through harness ports 46 and fastened to themselves. Hook-shaped or barbed harness ribbon 44 ends are also contemplated for engaging harness port 46 edges. See FIG. 4. Other harness 40 configurations are contemplated.

Figure 10:
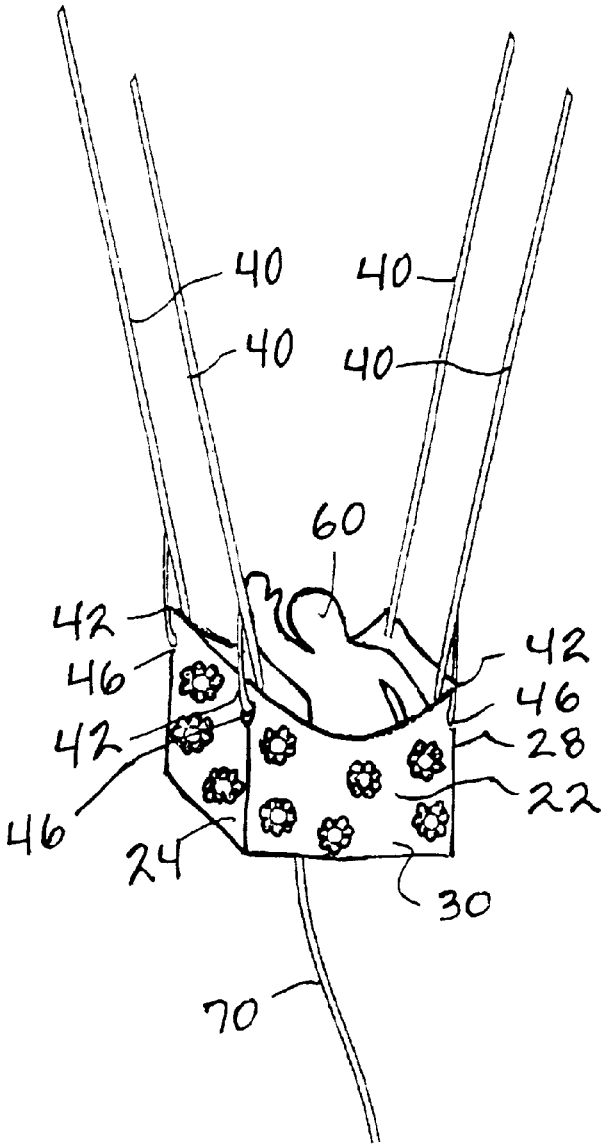
FIG. 10 is a view as in FIG. 4, showing the basket with harness ribbon ends engaging the ports with adhesively connected loops rather than hook ends, and with decorative flower images on the basket outer side wall surfaces.
Figure 11:
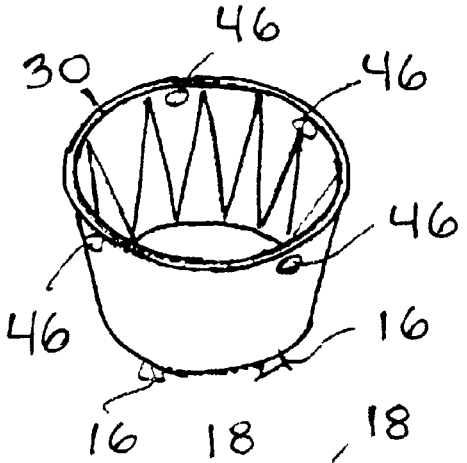
FIG. 11 is a perspective, partly unassembled view of the alternative cup-shaped basket with the bottom wall separated, the bottom wall having the tab slots for receiving engaging tabs along the lower edge of the basket circular side wall.
Figure 11A:
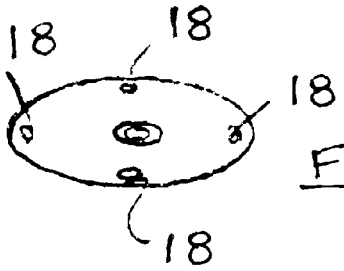
Figure 12:
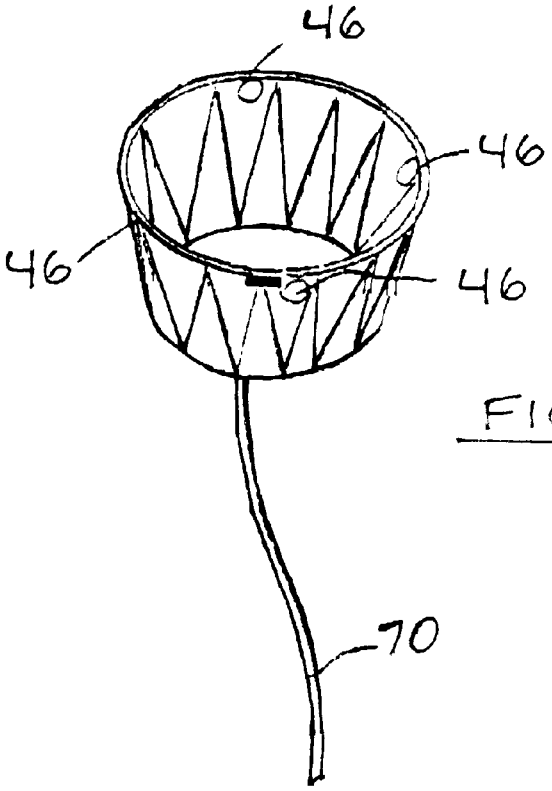
FIG. 12 is a perspective view of the basket of FIG. 11 shown fully assembled.
Figure 14:
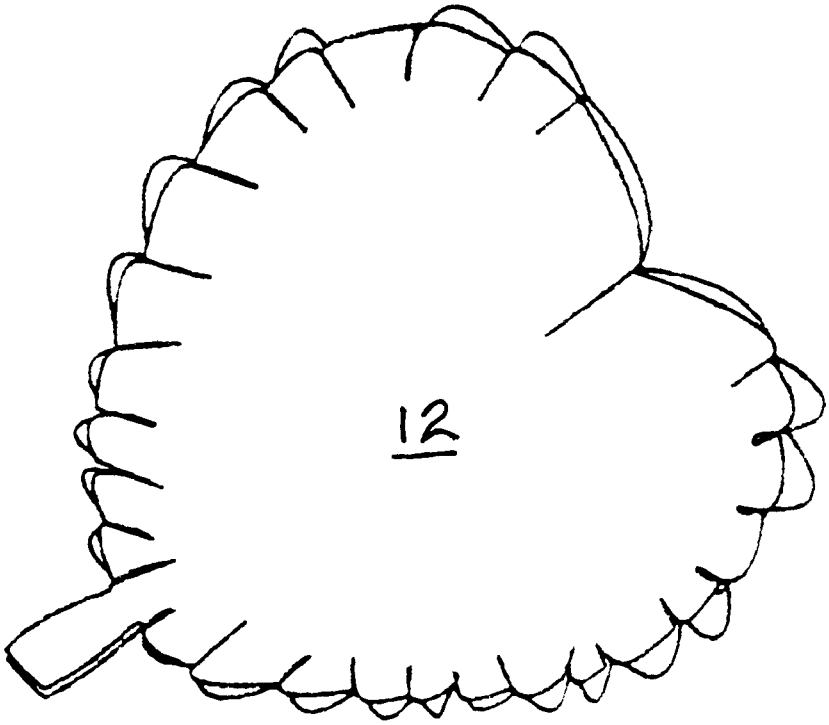
FIG. 14 is a perspective view of the two preferred types of party balloons which may be provided with the kit, with the mylar type on the left and the more common elastic type on the right.
Figure 14:
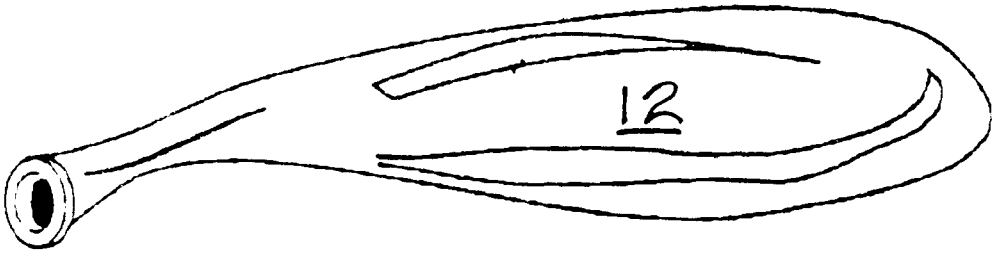

Assembled basket 30 functions as the handle portion of apparatus 50, and is preferably sized and configured so that the exterior surfaces of basket 30 may be gripped by a human hand to move apparatus 50 to a desired location. Basket 30 is preferably a cup-shaped structure having a four side wall panels 22–28 and a floor panel 32, or alternatively has a circular cup-shape with a removable bottom wall as shown in FIG. 10. Basket 30 is made of cardboard or plastic, although fabrication from other suitable materials is contemplated. The width of basket 30 is preferably, although not necessarily, a small fraction of the balloon 12 diameter to simulate the general proportional relationship of a passenger balloon 12 and basket 30. Kit 10 optionally includes a message carrying sign 60 in the form of an upright strip 62 of basket 30 material for securing to a side wall panel 22–28 of assembled basket 30 and projecting upwardly to a height substantially above that of the basket 30 side wall panels 22–28. The lower end of upright strip 62 preferably is coated with adhesive 56 which is in turn covered with a peel away sheet 58 for removal during apparatus assembly to expose adhesive 56 for placement against a basket side wall panel surface to mount sign 60. The upper end of strip 62 preferably extends laterally to provide a broad display surface 64 on which a message M is displayed, such as "Happy Birthday", or is configured and colored to resemble a person, an animal or a cartoon character. See FIGS. 1, 4 and 9. A basket-shaped sign (not shown) is contemplated as an alternative to the present basket 30.

Basket 30 and suspension harness 40, in combination, are of sufficiently minimal weight to be lifted or held suspended in the air by the buoyancy of helium-filled balloon 12. The entire weight of apparatus 50 is preferably balanced with the buoyancy of helium retained within the balloon 12 to create virtual equilibrium, so that balloon 12 remains essentially stationary in mid-air. If basket 30 is to carry an item 100, such as a piece of candy, the weight and buoyancy ratios are adjusted accordingly to achieve equilibrium. A balance trail ribbon 70 extends from basket 30.

One alternative version of apparatus 50 is illustrated in FIG. 10. In this version, the harness 40 loop of ribbon 42 is elastic and resiliently grips the central side region of the inflated balloon 12. The loop of ribbon 42 need not, in this instance, grip balloon 12 above the point of its widest central diameter.

The primary contemplated uses for apparatus 50 are as a novelty item and ornament at parties, birthdays, open houses, baby showers, weddings, and for general decoration and entertainment.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A kit for assembly of an entertainment apparatus, comprising:

a party balloon filled with a gas and which is buoyant in air at ambient pressure and temperature;

a basket structure form sheet comprising interconnected first, second, third and fourth basket wall panels and a basket floor panel, all said panels being separated from each other by fold lines, and panel interconnecting means for holding said side wall panels and floor panel juxtaposed in the configuration of a basket;

and a suspension harness comprising at least one elongate flexible member wrapped around said inflated party balloon and extending downwardly to and engaging said basket structure.

2. The kit of claim 1, wherein said party balloon is made of translucent colored elastic.

3. The kit of claim 1, wherein said party balloon is made of opaque plastic non-elastic mylar and is formed of two half-portions joined together at a circumferential seam.

4. The kit of claim 1, wherein said inflated party balloon has a balloon lower end with a balloon filling opening at the balloon lower end and has a balloon upper portion and a balloon lower portion and a balloon middle region between said balloon upper and lower portions and has a balloon middle region diameter, and wherein said suspension harness comprises:

a loop of ribbon of smaller diameter than said inflated party balloon middle region diameter and resting on and around the upper portion of said inflated party balloon and a plurality of said elongate flexible members tied to said loop of ribbon and extending downwardly to and secured to said basket structure.

5. The kit of claim 4, wherein the lower ends of said elongate flexible members are glued to said basket structure.

6. The kit of claim 4, wherein said basket structure comprises slots, and wherein the lower ends of said elongate flexible members are fitted through said slots.

7. The kit of claim 1, wherein said panel interconnecting means comprises: slots near the edges of said floor panel and dove tail tabs protruding from the edges of said wall panels which fit engagingly into said slots to hold the assembled basket in folded, assembled configuration.

8. The kit of claim 1, wherein said party balloon has a central side region and wherein said harness loop of ribbon is elastic and resiliently grips the central side region of said party balloon.

9. A kit for assembly of an entertainment apparatus, comprising:

a party balloon filled with a gas and which is buoyant in air at ambient pressure and temperature;

a basket structure form sheet comprising at least one side wall and a basket floor panel, all said panels being separated from each other by fold lines, and panel interconnecting means for holding said side wall panels and floor panel juxtaposed in the configuration of a basket having a cup-shaped structure;

and a suspension harness comprising at least one elongate flexible member wrapped around said inflated party balloon and extending downwardly to and engaging said basket structure.

10. The kit of claim 9, wherein said basket structure is made of cardboard.

11. The kit of claim 9, wherein said basket structure comprises a message carrying sign.

12. The kit of claim 11, wherein said sign comprises an upright strip secured to said at least one side wall of said basket structure and projecting upwardly to a height above said at least one side wall.

13. The kit of claim 12, wherein said strip has an upper end and wherein the upper end of said strip extends laterally to provide a broad display surface on which a message is displayed.

14. The kit of claim 9, wherein said party balloon is made of translucent colored elastic.

* * * * *